US010280055B2

(12) United States Patent
Menduni

(10) Patent No.: US 10,280,055 B2
(45) Date of Patent: May 7, 2019

(54) BALL JOINT LIFTING ASSEMBLY AND METHOD

(71) Applicants: Michael Joseph Menduni, Golden Meadow, LA (US); William von Eberstein, Madisonville, LA (US)

(72) Inventor: Michael Joseph Menduni, Houma, LA (US)

(73) Assignee: William von Eberstein, Madisonville, LA (US)

( * ) Notice: Subject to any disclaimer, the term of this patent is extended or adjusted under 35 U.S.C. 154(b) by 123 days.

(21) Appl. No.: 15/584,595

(22) Filed: May 2, 2017

(65) Prior Publication Data

US 2018/0319643 A1 Nov. 8, 2018

(51) Int. Cl.
*B66F 9/18* (2006.01)
*B66F 9/12* (2006.01)

(52) U.S. Cl.
CPC . *B66F 9/18* (2013.01); *B66F 9/12* (2013.01)

(58) Field of Classification Search
CPC ..... B66F 9/18; B66F 9/12; B66F 9/06; B66C 1/10; B66C 1/14; B66C 1/16; B66C 1/34; B66C 1/22
USPC ..... 294/81.56, 67.1, 82.12, 82.15; 414/607, 414/626
See application file for complete search history.

(56) References Cited

U.S. PATENT DOCUMENTS 1,022,298 A * 4/1912 Buller ..... A22B 5/06 294/81.2
1,172,489 A * 2/1916 Schellinger ..... A22B 5/06 294/81.56
2,231,416 A * 2/1941 Stahl ..... B66C 1/34 24/698.1
2,302,198 A * 11/1942 Ehmann ..... B66C 1/14 24/698.1
2,397,660 A * 4/1946 Hansen ..... B66C 1/34 24/698.1
2,452,778 A * 11/1948 Mathewson ..... B66C 1/34 248/341
2,558,388 A * 6/1951 Richardson ..... B66F 9/061 414/607

(Continued)

FOREIGN PATENT DOCUMENTS

DE 718095 C * 3/1942 ..... B66C 1/22
EP 2523 A1 * 6/1979

(Continued)

*Primary Examiner* — Gabriela M Puig
(74) *Attorney, Agent, or Firm* — Jones Walker LLP

(57) ABSTRACT

A lifting assembly for lifting a load including a frame and a rotation member. The frame includes a central portion interconnecting two spaced apart lifting portions and a suspension space defined below the central portion and between the lifting portions. The central portion includes an aperture. Each lifting portion is configured to engage a lifting device, such as a fork lift. The rotation member is disposed above the aperture of the central portion. The rotation member is a ball joint including a ball member that rotates and pivots within a rotation cavity. A fastener member attaches to the ball member and is suspended through the aperture of the frame's central portion. The fastener member is attached to a load to lift and suspend the load within or below the suspension space while allowing rotation and pivoting of the load relative to the frame.

16 Claims, 9 Drawing Sheets

(56) References Cited

U.S. PATENT DOCUMENTS 2,696,317 A * 12/1954 Toffolon ..... B66F 9/061 294/67.1
2,812,971 A * 11/1957 Teutsch ..... B66C 1/34 294/215
3,264,026 A * 8/1966 Hansen ..... B66F 9/12 248/301
3,788,492 A * 1/1974 Kraft ..... B66C 23/708 212/180
3,930,585 A * 1/1976 Lynch ..... B65G 59/02 414/607
4,065,013 A * 12/1977 Orthman ..... B66F 9/18 280/461.1
4,073,175 A * 2/1978 Seamon ..... B66F 9/187 294/68.3
6,042,165 A * 3/2000 Thompson ..... B66C 1/62 294/67.1
6,135,701 A * 10/2000 Galloway, Sr. ..... B66F 9/18 280/415.1
6,371,543 B1 * 4/2002 Fujikawa ..... B66C 1/125 294/82.11
7,214,025 B2 * 5/2007 Rudolph ..... B66F 9/18 186/63
7,654,551 B2 * 2/2010 Page ..... E02F 9/02 280/416.1
8,444,366 B2 * 5/2013 Cole ..... B66C 9/18 414/607
8,708,383 B1 * 4/2014 Roberts ..... B66F 9/18 294/67.33
2004/0189033 A1 * 9/2004 Stober ..... B66C 1/34 294/82.15
2007/0080549 A1 * 4/2007 Jenney ..... B66C 1/10 294/81.3
2016/0137462 A1 * 5/2016 Bakalyar ..... B66C 1/12 414/800

FOREIGN PATENT DOCUMENTS

EP 0053009 A2 * 6/1982 ..... B66C 1/12
FR 1497666 A * 10/1967 ..... B66C 1/34

* cited by examiner

BALL JOINT LIFTING ASSEMBLY AND METHOD

SUMMARY OF THE DISCLOSURE

A lifting assembly for lifting a load includes a frame and a rotation member. The frame includes a central portion interconnecting two spaced apart lifting portions and a suspension space defined below the central portion and between the lifting portions. The central portion includes an aperture. Each lifting portion is configured to engage a lifting device. The rotation member is disposed above the aperture of the central portion. A portion of the rotation member rotates and pivots relative to the frame.

In one embodiment, the rotation member includes a ball joint. The ball joint includes a top member, a bottom member, and a ball member. The top member and the bottom member engage one another to define a rotation cavity. The ball member is disposed within the rotation cavity. The rotation cavity is formed by a recessed surface of the top member and a bore through the bottom member. The bore of the bottom member includes a top bore portion with a curved profile. The bore further includes a lower bore portion with a restricted diameter relative to the top bore portion. The ball member includes an outer curved surface having a reciprocal shape to the curved profile of the top bore portion. The ball member rotates 360 degrees within the rotation cavity about a vertical axis and pivots 15 degrees from the vertical axis.

In one embodiment, the lifting assembly further includes a fastener member secured to the ball member and extending through the aperture of the frame. The fastener member rotates 360 degrees about the vertical axis and pivots 15 degrees from the vertical axis with the ball member. In another embodiment, each lifting portion includes a lifting receptacle for receiving a prong of a fork lift.

In an alternate embodiment, a lifting assembly for lifting a load includes a frame, a rotation member, and a fastener member. The frame includes a central portion interconnecting two spaced apart lifting portions and a suspension space defined below the central portion and between the lifting portions. The central portion includes an aperture. Each lifting portion is configured to engage a lifting device. The rotation member is disposed above the aperture of the central portion. A portion of the rotation member rotates and pivots relative to the frame. The fastener member is secured to the rotation member and extends through the aperture of the central portion. The fastener member rotates and pivots relative to the frame.

In one embodiment, the fastener member rotates 360 degrees about a vertical axis and pivots 15 degrees from the vertical axis. In another embodiment, the rotation member includes a top member, a bottom member, and a ball member. The ball member is disposed within a rotation cavity defined by the top member engaging the bottom member. The ball member rotates 360 degrees within the rotation cavity about the vertical axis and pivots 15 degrees from the vertical axis. The fastener member is secured to the ball member. In another embodiment, the load has a weight of 45 tons, and the lifting assembly is capable of suspending the load.

A method for lifting a load includes steps of: (a) providing a lifting assembly including: a frame including a central portion interconnecting two spaced apart lifting portions and a suspension space defined below the central portion and between the lifting portions, wherein the central portion includes an aperture, and wherein each lifting portion is configured to engage a lifting device; a rotation member disposed above the aperture of the central portion, wherein a portion of the rotation member rotates and pivots relative to the frame; (b) attaching a fastener member to a load; (c) attaching the fastener member to the rotation member to suspend the load within or below the suspension space; (d) engaging the lifting portions of the lifting assembly with a lifting device; and (e) lifting the load with the lifting device. In one embodiment, the lifting device is a fork lift.

In one embodiment, the method further includes the step of: (f) using the lifting device to rotate or pivot the load relative to the frame within the suspension space.

In another embodiment, the rotation member includes a top member, a bottom member, and a ball member. The ball member is disposed within a rotation cavity defined by the top member engaging the bottom member. The ball member rotates and pivots within the rotation cavity. In step (c), the fastener member is attached to the ball member. In step (f), the ball member and the fastener member rotate or pivot as the load rotates or pivots.

In one embodiment, the lifting device lifts a first end of the load in step (e), and the method further includes the steps of: (d1) providing a second lifting assembly including: a second frame including a second central portion interconnecting two spaced apart lifting portions and a second suspension space defined below the second central portion and between the lifting portions, wherein the second central portion includes an aperture, and wherein each lifting portion is configured to engage a second lifting device; a second rotation member disposed above the aperture of the second central portion, wherein a portion of the second rotation member rotates and pivots relative to the second frame; (d2) attaching a second fastener member to a second end of the load; (d3) attaching the second fastener member to the second rotation member to suspend the second end of the load within or below the second suspension space; (d4) engaging the lifting portions of the second lifting assembly with a second lifting device; and (e1) lifting the second end of the load with the second lifting device to completely suspend the load.

In one embodiment, the method further includes the step of: (f) transporting the load with the lifting device and the second lifting device, wherein the first end of the load rotates or pivots relative to the frame of the lifting assembly, and wherein the second end of the load rotates or pivots relative to the second frame of the second lifting assembly.

In another embodiment, the portion of the rotation member and the portion of the second rotation member each rotates 360 degrees about a vertical axis and 15 degrees from the vertical axis. In one embodiment, the load weighs 45 tons.

DETAILED DESCRIPTION OF THE INVENTION

Figure 1:
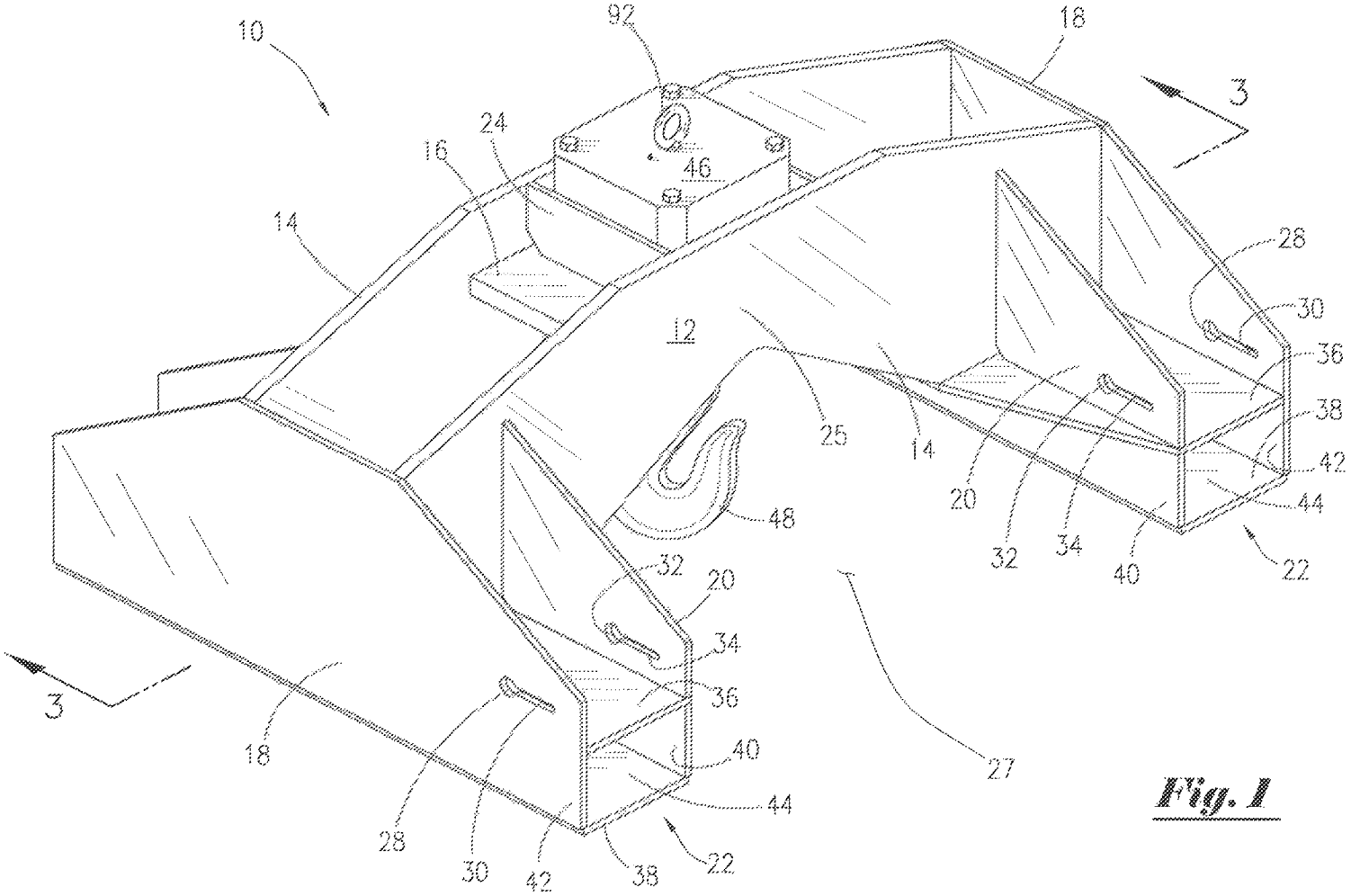
FIG. 1 is a perspective view of a lifting assembly.
Figure 2:
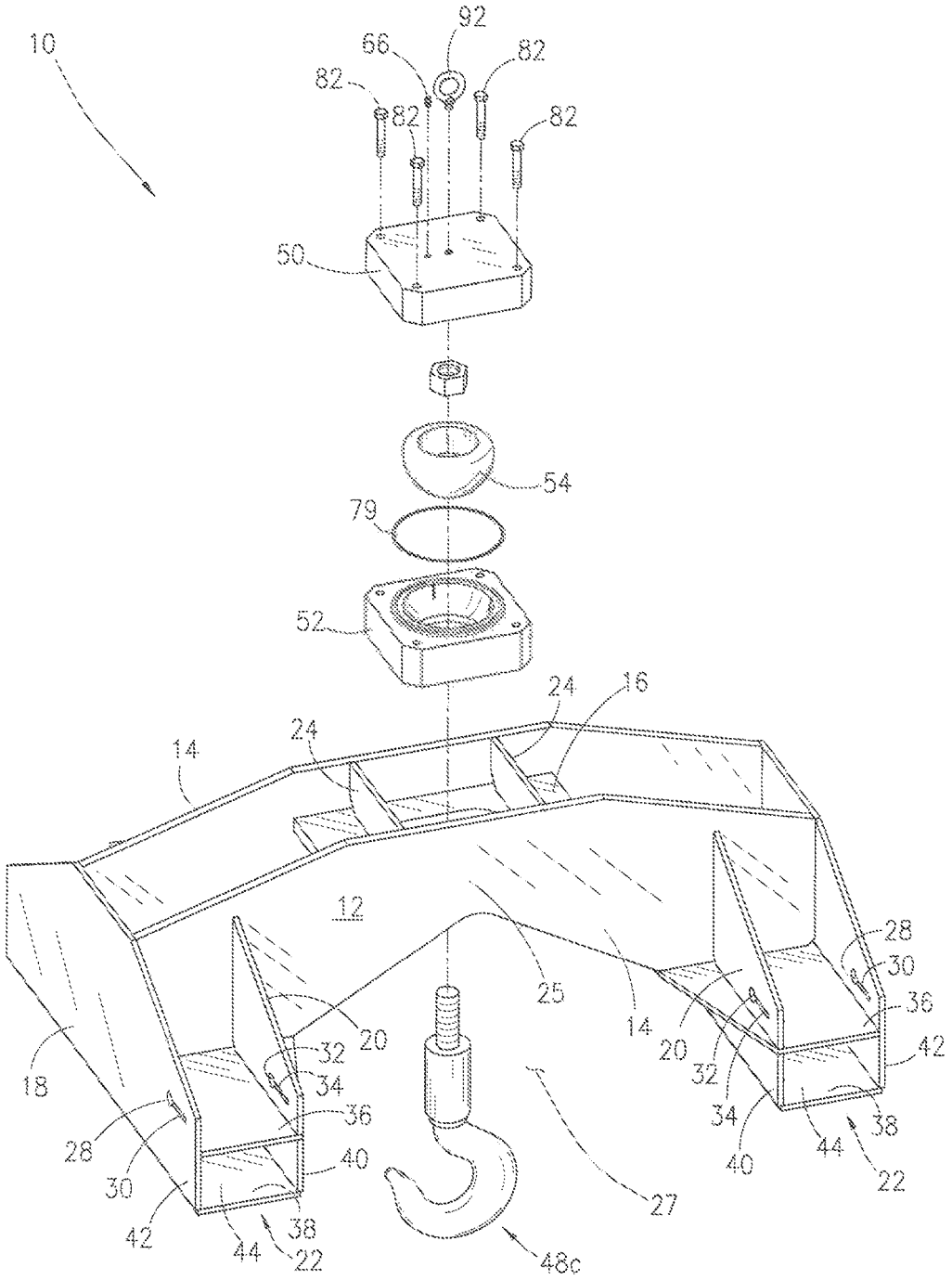
FIG. 2 is an exploded perspective view of the lifting assembly.
Figure 3:
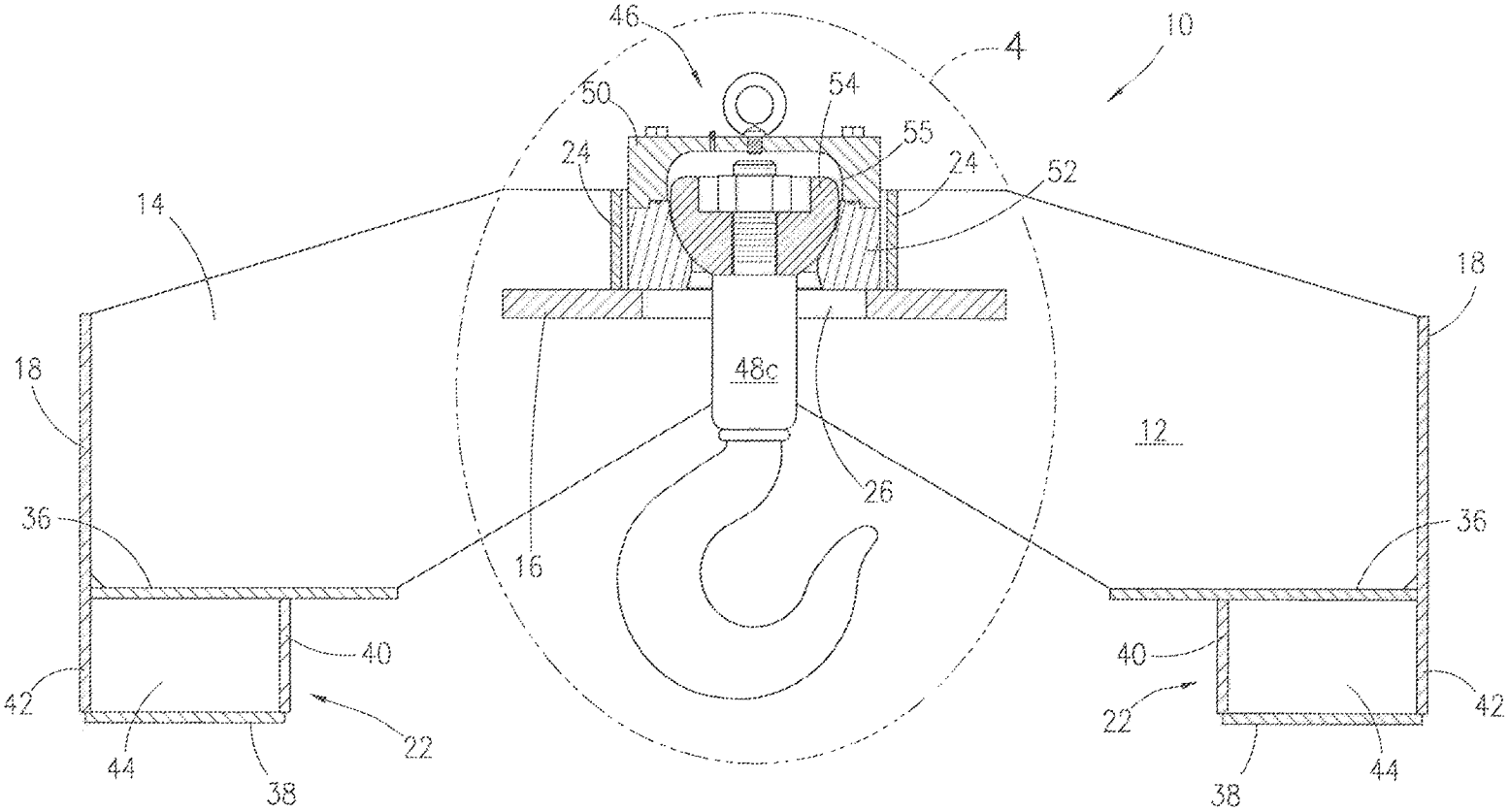
FIG. 3 is a cross sectional view of the lifting assembly.

An improved lifting assembly is disclosed herein. One embodiment of the lifting assembly is shown in FIGS. 1-3. The lifting assembly can be used in applications to lift and transport heavy loads, such as loads weighting up to 45 tons. One exemplary use is to lift and transport tubular members, such as marine risers. Risers are generally long tubular members that can be heavy and therefore difficult to lift and transport. For example, but not by way of limitation, risers can be 5 to 90 feet long and weigh between 4 and 65 tons. Lifting and transporting such large and heavy loads using conventional lifting devices resulted in wear on D-rings, shackles, and other fasteners used to connect the load to the lifting assembly. The wear was caused by the connecting assembly and other fasteners rubbing against each other. The improved lifting assembly disclosed herein is capable of lifting heavier loads and allowing the fastener member to rotate about a vertical axis and pivot, which reduces the wear of the fasteners against each other. The improved lifting assembly may have a generally rectangular shape, a generally square shape, a generally oval shape, or a generally circular shape.

Referring to FIGS. 1-3, in one embodiment, the lifting assembly 10 includes a frame 12. The frame 12, includes side members 14, support member 16, outer braces 18, inner braces 20, lifting portions 22, and support braces 24. In the embodiment shown in FIGS. 1-3, there are two side members 14. The side members 14, support member 16, outer braces 18, inner braces 20, lifting portions 22, and support braces 24 may be made of the same material or different materials. The side members 14 and support member 16 form central portion 25 of frame 12. The central portion interconnects the two lifting portions 22. Suspension space 27 is defined below the central portion of the frame 12 and between the two lifting portions 22.

With reference to FIGS. 1-3, 5, and 6, side members 14 are similarly shaped and spaced apart from each other. In this embodiment, each side member has a middle section connecting two end sections. The middle section can have a substantially flat upper surface with the two end sections sloping downward away from the flat upper surface. The lower surface of the side members 14 may slop upwards from the end sections, forming a "V" or "U" at the center of the middle section of the side member. The lower surface of each end section continues the slope from the lower surface of the middle section and ends in a substantially flat portion of the lower surface. The substantially flat portion of the lower surface of the end sections are operatively connected to the lifting portions 22. Each side member 14 may be integrally formed or the side members 14 may be formed of multiple pieces that are connected together, such as through welding. Side members 14 may be formed of any material that is capable of supporting the load to be lifted and/or transported. In some embodiments, side members 14 may be made of a metal or metal allow. In one embodiment, side members 14 are each made of A572 Grade 50 plate steel. Side member 14 can be about 90 to about 100 inches long, or any subrange therein, and about 23 to about 33 inches in height, or any subrange therein. The end section can be about 24.5 to about 34.5 inches long, or any subrange therein. The outer portions of each end section can be about 14.25 to about 24.25 inches in height, or any subrange therein. Side members 14 can be about 1 to about 2 inches thick, or any subrange therein. In one embodiment, each side member 14 is approximately 95 inches from end to end. In this embodiment, the middle section is approximately 36 inches long and each end section is approximately 29.5 inches long. Further in this embodiment the side members 14 are approximately 28 inches tall and the outer portions of each end section is approximately 19¼ inches tall. Finally, in this embodiment, the side members 14 are approximately 1.5 inches thick.

Referring still to FIGS. 1-3, 5, and 6, support member 16 is connected to the inward facing sides of each side member 14. Support member 16 may be connected to side members 14 through welding or through the use of bolts or other fasteners. In one embodiment, and as shown in FIGS. 1 and 2, support member 16 is connected to the middle section of each side member 14. In a further embodiment, support member 16 is positioned approximately mid-way down the inward facing sides of the middle section of each side member 14, as shown in FIG. 2. Support member 16 may be formed of any material that is capable of supporting the selected load. In one embodiment, support member 16 is made from A572 Grade 50 plate steel. Support member 16 made be formed of the same or different material than that of side members 14. Support member 16 can be about 19 to about 24 inches wide, or any subrange therein. The distance between the spaced apart side members 14 can be about 19 to about 24 inches, or any subrange therein. Support member 16 can be about 31 to about 100 inches long, or any subrange therein. Support member 16 can be about 1.5 to about 2.5 inches thick, or any subrange therein. In one embodiment, support member 16 is approximately 19 inches wide, which makes the distance between the spaced apart side members 14 approximately 19 inches. In this embodiment, support member 16 is approximately 36 inches long. In another embodiment, support member 16 is approximately 2 inches thick.

As shown in FIGS. 3-6, support member 16 includes an aperture 26, which extends from the upper surface of support member 16 to the lower surface of support member 16. While aperture 26 is shown as having actuate ends connected by straight sides, aperture 26 can be any shape that allows the lifting assembly 10 to be fastened to a load, including circular, oval, square, or rectangular. In one embodiment, aperture 26 is positioned so that it is centered in support member 16 so that there is an approximately equal amount of area on either side of aperture 26 and on either end of aperture 26. Aperture 26 can be about 16 to about 21 inches in length, or any subrange therein, and about 8 to about 13 inches wide, or any subrange therein. In one embodiment, aperture 26 is approximately 16 inches in length and approximately 8 inches wide.

Now referring to FIGS. 1-3, 5, and 6, in some embodiments in frame 12 also include outer braces 18. In one embodiment, the frame 12 includes two outer braces 18 and each outer brace 18 is positioned on an opposing end of the frame 12 from the other outer brace 18 and each outer brace 18 is connected to the ends of side members 14. Outer braces 18 can be connected to side members 14 through welding or the use of fasteners such as bolts, screws, etc. In one embodiment, outer brace 18 has a middle section positioned between two end sections. The upper surface of the middle section is flat. The upper surface of the end sections slope downwards from the flat upper surface of the middle section. The lower surface of the outer braces 18 is flat and substantially parallel to the upper surface of the middle section. In a further embodiment, the end sections of outer brace 18 terminate so that the end faces of the outer brace 18 are perpendicular to the lower surface of outer braces 18. In a further embodiment, the middle section of outer braces 18 is connected to the side members 14. In one embodiment, outer braces 18 may be formed of any material that is capable of supporting the selected load. In one embodiment, outer braces 18 are made of metal or a metal alloy. In one embodiment, outer braces 18 are A572 Grade 50 plate steel. Outer brace 18 can be about 60 to about 96 inches long, or any subrange therein, and about 23 to about 33 inches in height, or any subrange therein. Middle section can be about 17 to about 37 inches long, or any subrange therein. Each end section can be about 45 to about 65 inches long, or any subrange therein. The terminal ends of the end sections can be about 9 to about 19 inches in height, or any subrange therein. Outer braces 18 can be about 0.75 to about 1.5 inches wide, or any subrange therein. In one embodiment, outer brace 18 can be about 72 inches long. In a further embodiment, the middle section can be about 22 inches long. In a still further embodiment, each end section can be about 50 inches long. In another embodiment, outer brace 18 may be about 28 inches in height. In a further embodiment, the terminal ends of the end sections may be about 14 inches in height. In one embodiment, outer braces 18 are approximately 0.75 inches wide.

Referring to FIGS. 1 and 2, in one embodiment, each outer brace 18 includes aperture 28. Apertures 28 of both outer braces 18 are substantially aligned with one another on the same side of the frame 12. In a further embodiment, slots 30 extend from each aperture 28 towards the terminal ends of the end section of each outer brace 18. Slots 30 are positioned so that they are substantially aligned with one another. Slots 30 may be used for attachment of safety chains to lifting assembly 10. The center of aperture 28 can be about 10 to about 15 inches from the terminal end of the end section of outer brace 18, or any subrange therein. The center of aperture 28 can be about 11.75 to about 12.75 inches from the lower surface of outer brace 18, or any subrange therein. Slot 30 can terminate about 4 to about 12 inches from the terminal end of the end section of outer brace 18, or any subrange therein. The slots 30 can be about 6 to about 12 inches in length, or any subrange therein. The sides of slots 30 can be about 0.75 to about 1 inch apart, or any subrange therein (i.e., the width of slots 30). In one embodiment, the center of aperture 28 is approximately 10 inches from the terminal end of the end section of outer brace 18 and 11.75 inches from the lower surface of outer brace 18. In a still further embodiment, slot 30 terminates approximately 4 inches from the terminal end of the end section of outer brace 18. In a still further embodiment, the sides of slots 30 are approximately 0.75 inch apart and there is approximately 6 inches from the middle of aperture 28 to the end of slot 30.

Still again to FIGS. 1, 2, 5, and 6, in some embodiments the frame 12 also includes inner braces 20. In the embodiment shown in FIGS. 1 and 3, the frame 12 includes four inner braces 20. Inner braces 20 are connected to the outward facing side of side members 14 and extend away from side members 14. In a further embodiment, inner braces 20 are connected to the end sections of side members 14. In one embodiment, inner braces 20 are welded to side members 14. In another embodiment, inner braces 20 are connected to side members 14 with fasteners. A non-limiting list of fasteners includes bolts and screws. Inner braces can be substantially parallel to outer braces 18. Inner braces 20 have a lower surface that is substantially flat. In one embodiment, inner braces 20 have a first height where they connect to side members 14 and a second height at the terminal end of inner braces 20. In a further embodiment, the first height is greater than the second height and the upper surface of inner brace 20 slopes downward away from side member 14. The first height of inner braces 20 can be about 15 to about 25 inches, or any subrange therein. The second height of inner braces 20 can be about 6 to about 10 inches, or any subrange therein. Inner brace 20 can be about 20 to about 30 inches long, or any subrange therein. Inner braces 20 can be 0.75 to 1 inch wide, or any subrange therein. In still a further embodiment, the first height is approximately 20 inches and the second height is approximately 6 inches. In another embodiment, inner brace 20 is approximately 25 inches long. In one embodiment, inner braces 20 are approximately 0.75 inches wide. In still another embodiment, the terminal end of inner brace 20 is substantially planar with the terminal end of the adjacent outer brace 18. Inner brace 20 may be formed of any material having sufficient strength to support the selected load. In one embodiment, inner brace 20 is formed of a metal or metal alloy. In a further embodiment, inner brace 18 is A572 Grade 50 plate steel.

As shown in FIGS. 1 and 2, in some embodiments where outer braces 18 have apertures 28, the inner braces that are on the same side of the frame 12 as the apertures 28 also have apertures 32. Apertures 32 are approximately the same size as apertures 28 and are substantially aligned with apertures 28. In a further embodiment, slots 34 extend from each aperture 32 towards the terminal ends of inner brace 20. Slots 34 and slots 30 may be used for attachment of safety chains to lifting assembly 10. Slots 34 are positioned so that they substantially aligned with slots 30 in outer brace 18. The center of aperture 32 can be about 10 to about 15 inches from the terminal end of inner brace 20, or any subrange therein. The center of aperture 32 can be about 11.75 to about 12.75 inches from the lower surface of inner brace 20, or any subrange therein. Slot 34 can terminate about 4 to about 12 inches from the terminal end of inner brace 20, or any subrange therein. The slots 34 can be about 6 to about 12 inches in length, or any subrange therein. The sides of slots 34 can be about 0.75 to about 1 inch apart, or any subrange therein (i.e., the width of slots 34). In one embodiment, the center of aperture 32 is approximately 10 inches from the terminal end of inner brace 20 and 3 inches from the lower surface of inner brace 20. In a still further embodiment, slot 34 terminates approximately 4 inches from the terminal end of inner brace 20. In a still further embodiment, the sides of slots 34 are approximately 0.75 inch apart and there is approximately 6 inches from the middle of aperture 32 to the end of slot 34.

Referring to FIGS. 1-3, 5 and 6, in some embodiments, frame 12 has support braces 24. Frame 12 has two support braces 24. Support braces 24 are positioned on the upper surface of support member 16 between side members 14. Support braces 24 are positioned on opposite sides of aperture 26 in support member 16. Support braces 24 are connected to support member 16 and both side members 14. Non-lifting examples of the means by which the support braces 24 can be connected to support member 16 and side members 14 include welding and fasteners (including, but not limited to, bolts and screws). In another embodiment, the upper surface of support braces 24 are aligned with the upper surface of side members 14. Support braces 24 may be formed of any strong material. In one embodiment, support braces 24 are formed of a metal or a metal alloy. In a further embodiment, support braces 24 are A572 Grade 50 plate steel. Support braces 24 are sized to fit between the side members 14. Support braces 24 can be about 18 to about 24 inches in length, or any subrange therein, and about 7 to about 17 inches in height, or any subrange therein. Each support brace 24 can be positioned about 9 to about 12.75 inches from the end of support member 16, or any subrange therein. Support braces 24 can be about 0.75 to about 2 inches thick, or any subrange therein. In one embodiment, support braces 24 are approximately 19 inches long and fit flush against the inner side of each side member 14. In another embodiment, support braces 24 are approximately 7 inches in height. In another embodiment, support braces 24 are approximately 0.75 inch thick. In yet another embodiment, each support brace 24 is positioned approximately 7.75 inches from the end of support member 16.

Referring to FIGS. 1-3 and 6, lifting portions 22 of frame 12 each includes top support 36, bottom support 38, and side supports 40 and 42. The top support 36 is connected to the bottom support 38 by the side supports 40 and 42, forming aperture 44. Aperture 44 is sized so that it can receive at least a portion of a lifting device. Each side support 40 may be integrally formed with inner brace 20. Alternatively, each side support 40 may be formed separately from and attached to inner brace 20. Each side support 42 may be integrally formed with outer brace 18. Alternatively, each side support 42 may be formed separately from and attached to outer brace 18.

Still referring to FIGS. 1-3, 5, and 6, top support 36 is connected to outer brace 18 and inner brace 20. Non-limiting examples of the means by which the top support 36 can be connected to outer brace 18 and inner brace 20 include welding and fasteners (including, but not limited to, bolts and screws). In one embodiment, as shown in FIGS. 1-3 and 6, top support 36 is connected to the inner facing side of outer brace 18 and the lower surface of inner brace 20. However, in other embodiments, the positioning of the top support 36 could be such that it connects to the lower surfaces of both the outer brace 18 and the inner brace 20 (in embodiments where outer brace 18 and inner brace 20 have a substantially equal height). In some embodiments, top support 36 extends inward beyond inner brace 20. Top support 36 is shaped such that it has a first side that is flush with outer brace 18 and each end is aligned with the terminal ends of outer brace 18 and inner brace 20. In some embodiments, the ends of top support 36 are perpendicular to both outer brace 18 and inner brace 20. In some embodiments, the second side of top support 36 slopes towards the interior of frame 12 such that is has a width that generally increases from the ends of top support 36 towards the middle portion of top support 36. The middle portion of second side of top support 36 is substantially parallel to outer brace 18. Top support 36 may be made of any material that is suitable to support the selected load. In one embodiment, top support 36 is metal or a metal alloy. In a further embodiment, top support 36 is A572 Grade 50 plate steel. In one embodiment, top support 36 is approximately the same length as outer brace 18. In another embodiment, the middle portion of top support 36 is approximately the same length as the middle section of outer brace 18. Top support 36 can be about 67 to about 77 inches in length, or any subrange therein, and about 14.25 to about 24.25 inches tall, or any subrange therein. The middle portion of top support 36 can be about 17 to about 27 inches in height, or any subrange therein, and about 22 to about 30 inches in length, or any subrange therein. Top support 36 can be about 0.75 to about 1 inch thick, or any subrange therein. In another embodiment, top support 36 if approximately 72 inches long. In still another embodiment, the ends of top support 36 are approximately 14.25 inches tall. In a further embodiment, the middle portion of top support 36 is approximately 22 inches tall. In yet another embodiment, the middle portion of top support 36 is approximately 22 inches long. In still another embodiment, top support 36 is approximately 0.75 inches thick.

As shown in FIGS. 1-3 and 6, side supports 40 and 42 connect up support 36 to bottom support 38. Non-limiting examples of the means by which side supports 40 and 42 can be connected to top support 36 and bottom support 38 include welding and fasteners (including, but not limited to, bolts and screws). Side supports 40 and 42 are similarly sized with each other. In some embodiments, and as shown in FIGS. 1-3 and 6, side support 42 is the bottom portion of outer brace 18. Side supports 40 and 42 may be formed of any material having sufficient strength to support the selected load. In one embodiment, side supports 40 and 42 are formed of metal or a metal alloy. In a further embodiment, side supports 40 and 42 are A572 Grade 50 plate steel. In one embodiment, side supports 40 and 42 are approximately the same length as outer brace 18. Side supports 40 and 42 can be about 67 to about 77 inches in length, or any subrange therein. Side support 40 can be about 6 to about 10 inches in height, or any subrange therein. Side support 42 can be about 12 to about 30 inches in height, or any subrange therein. Side supports 40 and 42 can be about 0.75 to about 1 inch thick, or any subrange therein. In one embodiment, side supports 40 and 42 are approximately 72 inches long. In another embodiment, side supports 40 and 42 are approximately 8 inches in height. In yet another embodiment, side supports 40 and 42 are approximately 0.75 inch thick.

As shown in FIGS. 1-3 and 6, bottom support 38 is connected to side supports 40 and 42. In one embodiment, bottom support 38 is approximately the same length as side supports 40 and 42. In another embodiment, bottom support 38 is approximately the same width the ends of top support 36. Bottom support 38 may be formed of any material that is suitable to support the selected load. In one embodiment, bottom support 38 is formed of a metal or a metal alloy. In a further embodiment, bottom support 38 is A572 Grade 50 plate steel. Bottom support 38 can be about 67 to about 77 inches in length, or any subrange therein, and about 9.25 to about 19.25 inches wide, or any subrange therein. Bottom support 38 can be about 0.75 to about 1 inch thick, or any subrange therein. In one embodiment, bottom support 38 is approximately 72 inches long. In another embodiment, bottom support 38 is approximately 14.25 inches wide. In still another embodiment, bottom support 38 is approximately 0.75 inch thick.

Referring now to FIGS. **1-4*b* and 7-15, lifting assembly 10 also includes rotation member 46. Fastener member 48 is operatively suspended from rotation member 46 through aperture 26 of support member 16. Rotation member 46 can be any apparatus or device capable of being positioned on support member 16 and that allows both rotation of fastener member 48 about a vertical axis and pivoting of the fastener member 48 from the vertical axis. In the embodiments shown in the figures, rotation member 46 is a ball joint. Rotation member 46 is dimensioned to fit in a receptacle space on support member 16 between side members 14 and support braces 24**.

With reference to FIGS. 2-4*b*, rotation member 46 includes top member 50, bottom member 52, and ball member 54. Rotation cavity 55 is formed when top member 50 and bottom member 52 are operatively connected together. Ball member 54 is retained within the rotation cavity 55.

Figure 7:
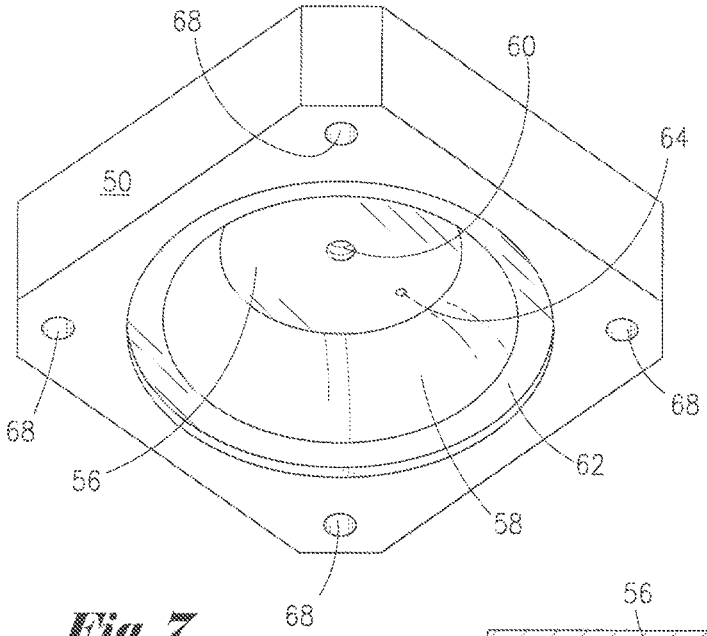
FIG. 7 is a perspective view of a top member of the ball joint.
Figure 8:
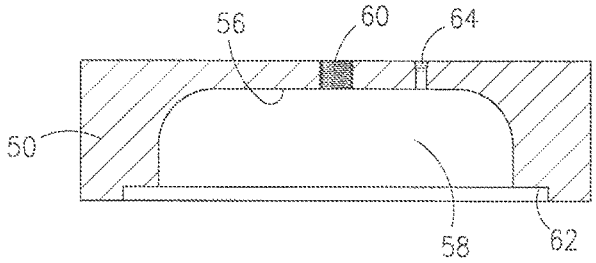
FIG. 8 is a cross sectional view of the top member of the ball joint, taken along the line 8-8 in FIG. 9.
Figure 9:
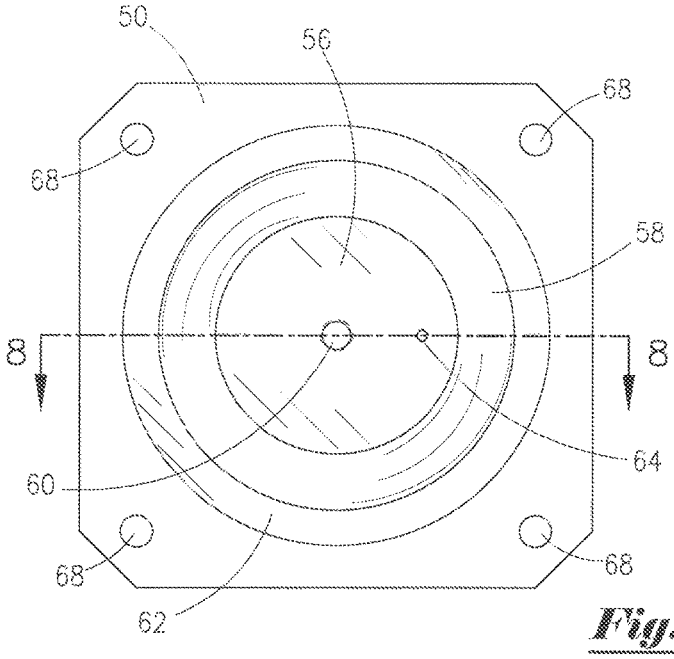
FIG. 9 is a bottom view of the top member of the ball joint.

Referring to FIGS. 7-9, top member 50 has an upper surface, a bottom surface, and an interconnecting side surface. Top member 50 includes recessed surface 56 in a lower portion of top member 50. Released surface 56 defines ball member area 58, which forms the upper portion of rotation cavity 55. Recessed surface 56 may have any shape configured to allow the desired movement of ball member 54 within rotation cavity 55 of rotation member 46. In one embodiment, recessed surface 56 may have an approximate dome shape. Top member 50 may also include central bore 60 extending from the upper surface to recessed surface 56. Central bore 60 may be dimensioned to receive a portion of a fastener member described below. The bottom surface of top member 50 may include recessed shoulder 62 disposed between the side surfaces and recessed surface 56.

In one embodiment, and as shown in FIGS. 7-9, top member 50 includes one or more additional bores. For example, top member 50 may include bore 64 extending from the upper surface of top member 50 to recessed surface 56. Bore 64 may be configured to engage an auxiliary component, such as grease fitting 66. In certain embodiments, top member 50 may include through bores 68. As shown in FIGS. 7 and 9, through bores 68 extend from the upper surface to the bottom surface of top member 50. Through bores 68 may be positioned along the periphery of the upper surface of top member 50. In a further embodiment, and as shown in FIGS. 7-9, top member 50 is substantially square and the through bores 68 are positioned adjacent to the corners of top member 50. Top member 50 can be about 15 to about 24 inches in length, or any subrange therein, and about 15 to about 24 inches wide, or any subrange therein. Top member can be about 4 to about 7 inches in height, or any subrange therein. The recessed shoulder 62 can be about 13 to about 20 inches in diameter, or any subrange therein. The diameter of recessed surface 56 can be about 11.5 to about 17.5 inches in diameter, or any subrange therein, where it meets the recessed shoulder 62. Recessed surface 56 can extend about 4 to about 6 inches from the bottom surface of the top member 50, or any subrange therein. In one embodiment, top member 50 may be approximately 18 inches long and approximately 18 inches wide. In another embodiment, top member 50 may be approximately 5 inches in height. In another embodiment, the recessed shoulder 62 may be approximately 15 inches in diameter. The recessed surface 56 may be approximately 12.5 inches in diameter where it meets recessed shoulder 62. In a further embodiment, recessed surface extends approximately 4 inches from the bottom surface of top member 50. Top member 50 may be formed of any material suitable for use with the ball member 54. In one embodiment, top member 50 may be formed of AISI 4130 alloy steel meeting Engineering Specification 157 (ES-157). In another embodiment, top member 50 may be formed of AISI 4140 alloy steel meeting ES-157.

Figure 10:
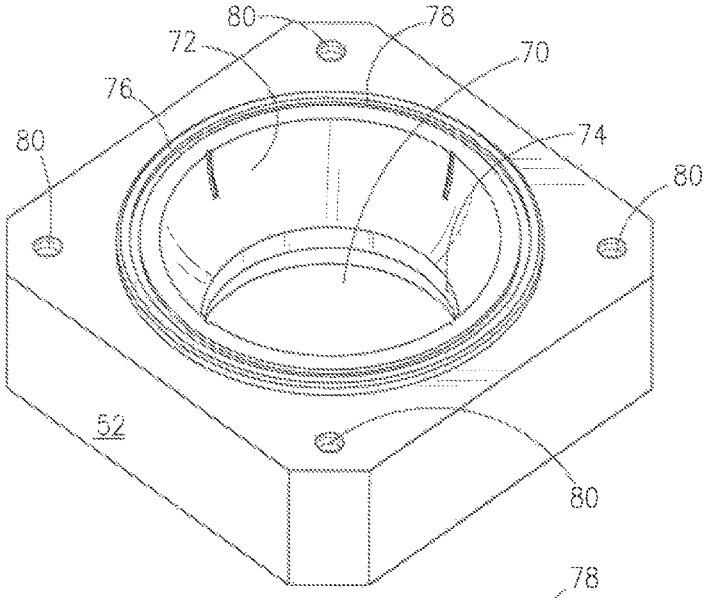
FIG. 10 is a perspective view of a bottom member of the ball joint.
Figure 11:
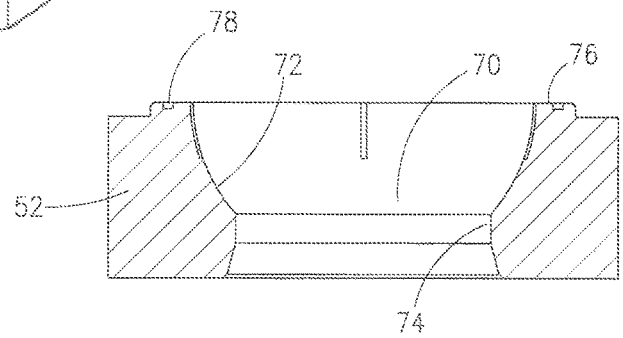
FIG. 11 is a cross sectional view of the bottom member of the ball joint, taken along the line 11-11 in FIG. 12.
Figure 12:
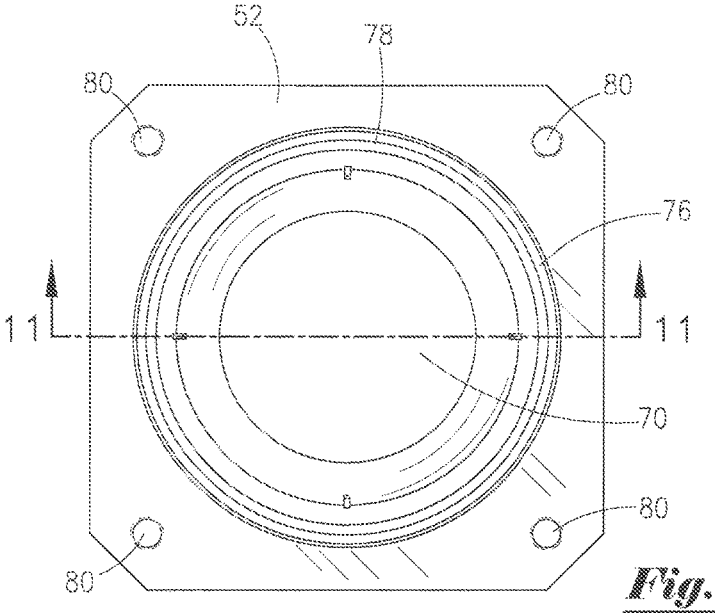
FIG. 12 is a top view of the bottom member of the ball joint.

Referring to FIGS. 10-12, bottom member 52 includes an upper surface, a bottom surface, a side surface, and bore 70. Bore 70 of bottom member 52 and ball member area 58 of top member 50 together define rotation cavity 55 of rotation member 46. Bore 70 may include supper portion 72 and lower portion 74 having a restricted diameter relative to upper portion 72. In one embodiment, a diameter of upper portion 72 is smaller than the diameter of recessed surface 56 of top member 50. The wall of upper portion 72 may include a curved profile as shown in FIGS. 10-12. A diameter of the curved profile may decrease from the upper surface of bottom member 52 to the lower portion 74 of bore 70. The curved profile may have a generally reciprocal shape to a portion of the outer surface of ball member 54. In one embodiment, the wall of lower portion 74 of bore 70 may include a first profile and a second profile. The first profile may have a generally cylindrical shape, while the second profile may have a flared shape between the first profile and the bottom surface of bottom member 52.

The bottom member 52 also includes a circumferential lip 76 on its upper surface surrounding through bore 70. Circumferential lip 76 abuts against top member lower shoulder 62. In one embodiment, circumferential lip 76 may have circumferential groove 78 in its surface. Circumferential groove is sized to retain o-ring 79, which forms a sealing connection between top member 50 and bottom member 52. Bottom member 52 may also have bores 80. Bores 80 align with through bores 68 in the top member 50. Fasteners 82 are received in through bores 68 and bores 80. Fasteners 82 function to removably connect top member 50 and bottom member 52. Fasteners 82 may be bolts or screws. Additionally, through bores 68 and bores 80 may be threaded. In one embodiment, bottom member 52 has approximately the same length and width as top member 50. In one embodiment, bottom member 52 has a height that is greater than the height of top member 50. Bottom member 52 can be about 15 to about 24 inches in length, or any subrange therein, and about 15 to about 24 inches wide, or any subrange therein. Bottom member can be about 5 to about 10 inches in height, or any subrange therein. Bores 80 can extend about 5 to about 10 inches into the upper surface of bottom member 52, or any subrange therein. Circumferential groove can be 0.345 to about 0.355 inches wide, or any subrange therein, and can extend 0.220 to 0.230 inches into the surface of the circumferential lip 76. Circumferential lip 76 can be lowered 0.010 inches below the upper surface of the bottom member 52. In one embodiment, bottom member 52 is approximately 18 inches long and approximately 18 inches wide. In another embodiment, bottom member 52 is approximately 5.75 inches in height. In another embodiment, bores 80 extend approximately 2.5 inches into the upper surface of bottom member 52. In one embodiment, circumferential groove 78 is approximately 0.35 inch wide and extends approximately 0.225 inch into the surface of the circumferential lip 76. In another embodiment, circumferential lip 78 is raised approximately 0.5 inch above the upper surface of bottom member 52. In another embodiment, the bottom member 52 is approximately 6.25 inches in height. Bottom member 52 may be formed of any material suitable for use with the ball member 54. In one embodiment, bottom member 52 may be formed of AISI 4340 alloy steel meeting Engineering Specification 81 (ES-182).

Figure 13:
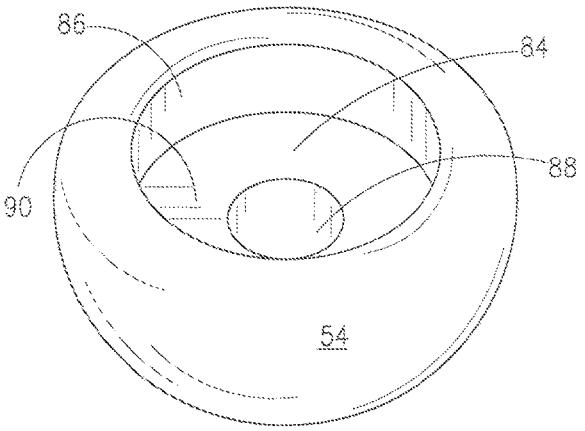
FIG. 13 is a perspective view of a ball member of the ball joint.
Figure 14:
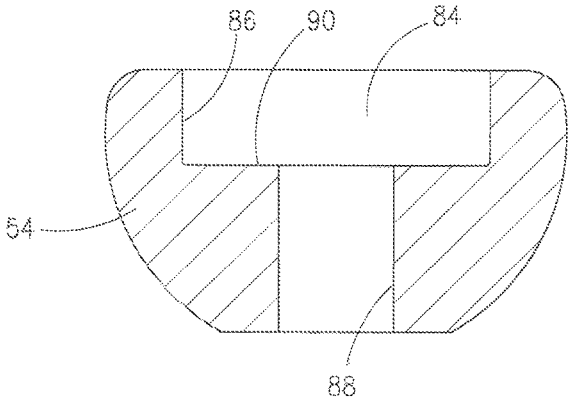
FIG. 14 is a cross sectional view of the ball member of the ball joint, taken along line 14-14 in FIG. 15.
Figure 15:
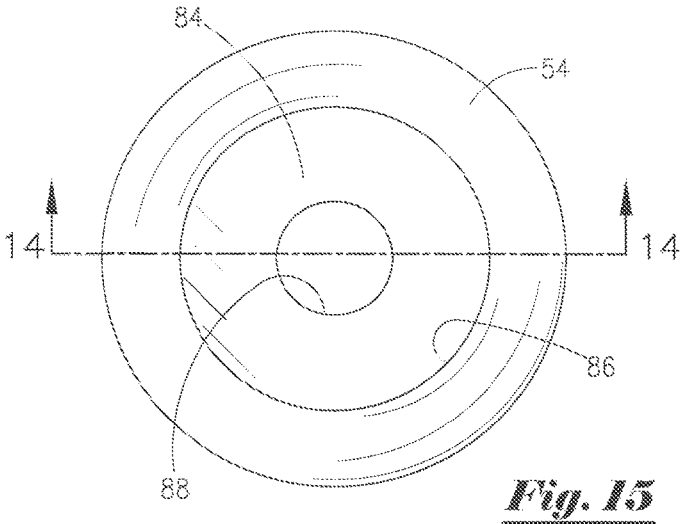
FIG. 15 is a top view of the ball member of the ball joint.

Referring to FIGS. 13-15, ball member 54 is retained within rotation cavity 55 formed when top member 50 is attached to bottom member 52. Ball member 54 has an upper surface, a curved outer surface, and a bottom surface. While ball member 54 has a curved outer surface, in one embodiment, ball member is not spherical. Ball member 54 includes through bore 84. Through bore has an upper portion 86, a lower portion 88 having a smaller diameter than upper portion 86, and a shoulder interconnecting upper portion 86 and lower portion 88. The curved outer surface of ball member 54 is configured to engage bore 70 of bottom member 52. At least a portion of ball member 54 has a larger diameter than the restricted diameter of lower portion 74 or bore 70. As shown in FIG. 4, the curved outer surface of ball member 54 engages the curved profile of upper portion 72 of bore 70, with a lower portion of ball member 54 extending into lower portion 74 of bore 70. The portion of ball member 54 disposed within lower portion 74 does not contact the wall of lower portion 74. Ball member 54 is retained within rotation cavity 55 of rotation member 46 by the curved profile of upper portion 72 and the restricted diameter of lower portion 74. Ball member 54 may rotate 360 degrees about a vertical axis within bore 70. As ball member 54 rotates, the curved outer surface of ball member 54 slides along the curved profile of upper portion 72 of bore 70. Ball member 54 may also pivot up to a predefined angle from the vertical axis. The predefined angle of pivot allowance may be defined by the cooperating profiles of upper portion 72 of bore 70 and the outer surface of ball member 54. In one embodiment, the cooperating profiles allow ball member 54 to pivot up to 15 degrees from the vertical axis.

Ball member 54 may be formed of any material suitable for use with the top member 50, bottom member 52, and suitable for use with the selected load. In one embodiment, ball member 54 may be formed of C95500HT Aluminum Bronze (alloy nickel aluminum bronze), which is an excellent anti-galling high strength bearing material. Ball member 54 can be about 5 to about 12 inches in height, or any subrange therein. Upper portion 86 of through bore 84 can be about 5 to about 10 inches in diameter, or any subrange therein, and can extend about 2 to about 3 inches into the upper surface of ball member 54, or any subrange therein. The lower portion 88 of through bore 84 can be about 2 to about 5 inches in diameter, or any subrange therein. The lower surface of ball member 54 can have a diameter of about 5 to about 12 inches, or any subrange therein. In one embodiment, ball member 54 is approximately 6.9 inches in height. In another embodiment, the upper portion 86 of through bore 84 is approximately 8 inches in diameter and extends approximately 2.5 inches into the upper surface of ball member 54. In another embodiment, the lower portion 88 of through bore 84 is approximately 3 inches in diameter. In yet another embodiment, the lower surface of ball member 54 has a diameter of 6 inches.

Referring to FIGS. 1-2, rotation member 46 may also include fastener member 92. Fastener member 92 can be any fastener that is capable of connecting the rotation member to another device, such as lifting device. In the embodiment shown in FIGS. 1-2, fastener member 92 is an eye bolt connected within central bore 60 of top member 50. In a further embodiment, the fastener member is a 1-inch eye bolt. Fastener member 92 allows rotation member 46 to be lifted and placed in or removed from the lifting frame. In one embodiment, central bore 60 may include threads configured to engage threads of fastener member 92. Alternatively, fastener member 92 may be configured to engage central bore 60 by any other known method.

Figure 4B:
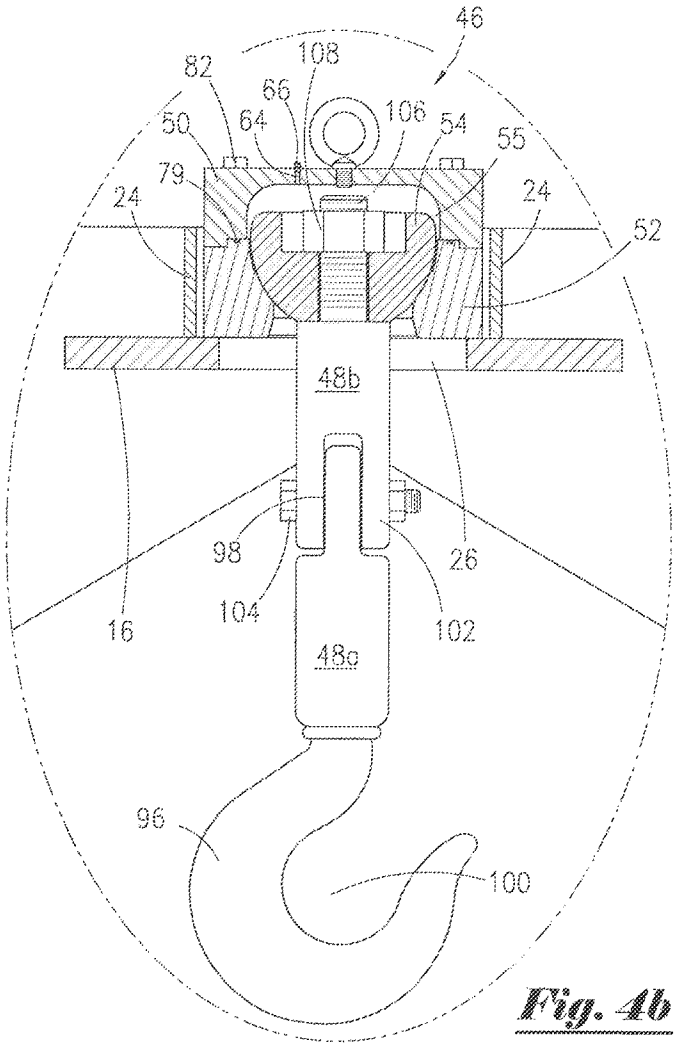
FIG. 4*b* is a cross sectional view of the ball joint of the lifting assembly shown in FIG. 3 with an alternate fastener member.
Figure 4A:
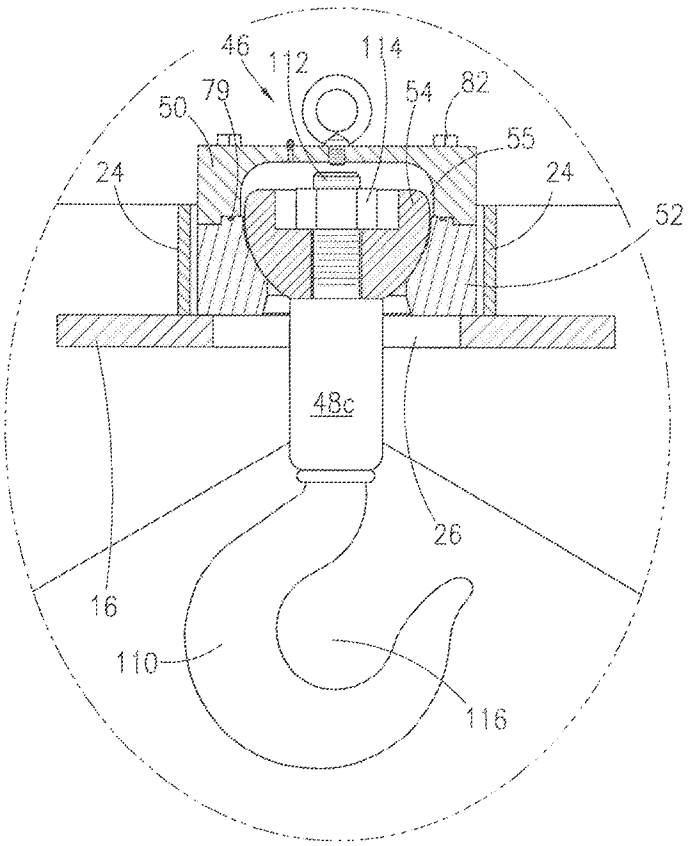
FIG. 4*a* is a cross sectional view of a ball joint of the lifting assembly shown in FIG. 3 with a fastener member.
Figure 5:
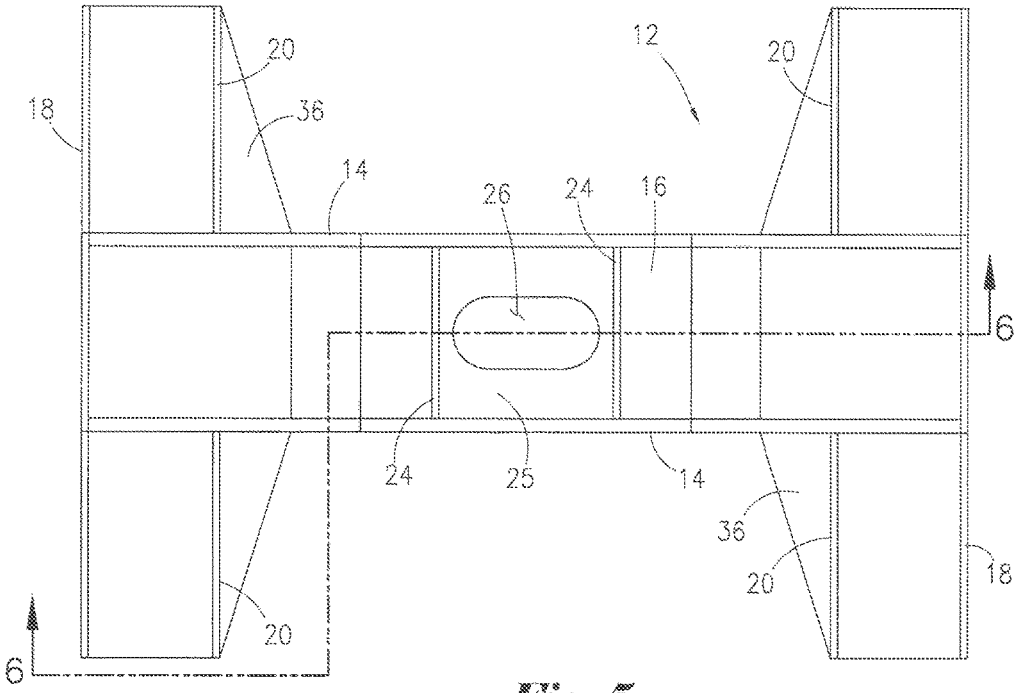
FIG. 5 is a top view of the frame of the lifting assembly.
Figure 6:
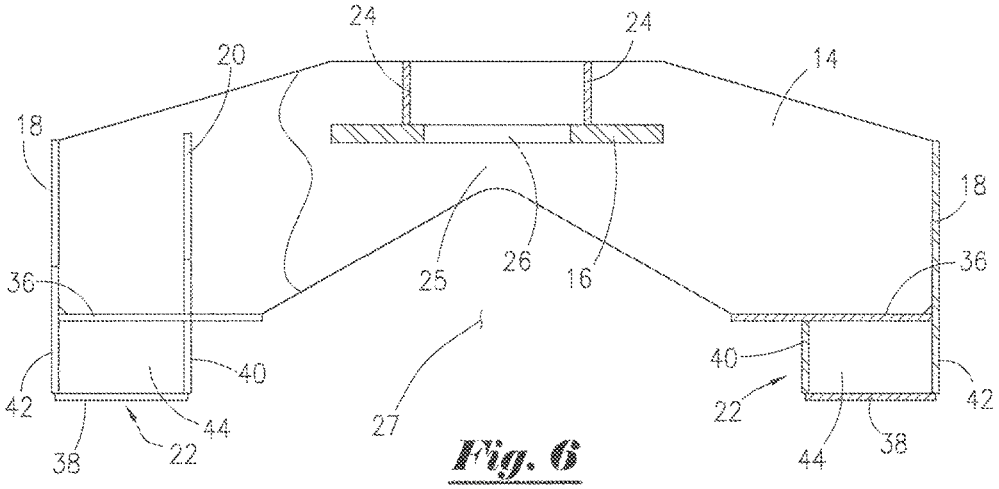
FIG. 6 is a partial cross section of the frame of the lifting assembly, taken along the line 6-6 in FIG. 5.

Referring to FIGS. 2-4*b*, fastener member 48 of lifting device 10 can be any apparatus or device that is capable of supporting a selected load and operatively connecting to the rotation member 46. When the rotation member 46 is a ball joint, fastener member 48 is operatively connected to ball member 54 through the through bore 84 in ball member 54. In one embodiment, and as shown in FIG. 4*b*, fastener member 48*a* includes a hook 96 and an eye 98. For this fastener member, a connecting assembly, including a rope, ties, chains, shackles, or D-rings is placed within the hook aperture 100. A connection engaging eye 98 may be used to connect hook 96 to ball member 54. Still referring to FIG. 4*b*, in another embodiment, fastener member 48*b* includes clevis 102. Clevis 102 has bores to receive a retaining member 104. Retaining member 104 can be a bolt. In this embodiment, fastener member 48*b* also includes a threaded end 106 opposite the clevis 102 and nut 108, which is threadedly fastened to threaded end 106. The fastener member 48*b* is operably connected to ball member 54 through a threaded engagement. A connecting assembly is placed within the area between the arms of clevis 102 and retained in the area by the retaining member 104. As shown in FIGS. 2, 3, and 4*a*, in yet another embodiment, fastener member 48*c* includes a hook 110 on one end and a threaded end 112 opposite the hook 110. Nut 114 engages the threaded end 112 to connect the fastener member 48*c* to ball member 54. The connecting assembly that attaches the fastener member 48*c* to a load is placed within the hook aperture 116.

Figure 16:
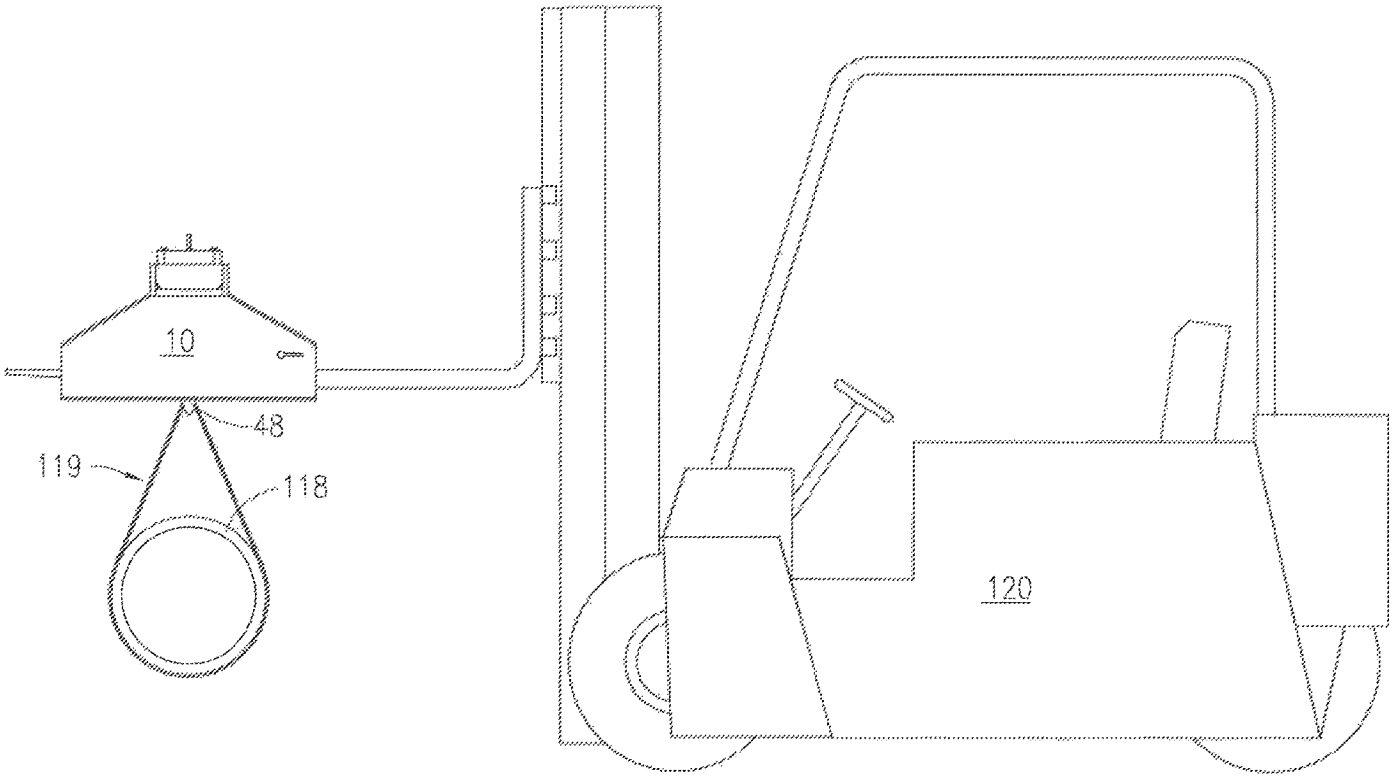
FIG. 16 is a side view of the lifting assembly in use with a lifting device to transfer a load.

Referring now to FIG. 16, to use the lifting assembly, a load 118 is removably connected to a connecting assembly 119. AS discussed above, the connecting assembly can be ropes, ties, chains, shackles, D-rings, or other apparatuses or devices that can be used to connect a load 118 such as a tubular member, to fastener member 48. A lifting device 120 engages the lifting portions 22 or the lifting assembly 10. The lifting device 120 can be any device that is capable of engaging lifting portions 22. In one embodiment, lifting device 120 is a forklift. Once the lifting device 120 engages the lifting portions 22 by, for example, placing the forks of a forklift in the apertures 44. If the connecting assembly 119 is not connected to the fastener member 48, then it may be connected now. Alternatively, the lifting device 120 may lift the lifting assembly 10 before attaching the connecting assembly 119 to the fastener member 48. Once the connecting assembly 119 with its attached load 118 is connected to the fastener member 48, the lifting device 120 may continue lifting the lifting assembly 10, for example by raising the forks of a forklift. The lifting assembly 120 also may then transport the load 118. In some embodiments, two lifting assemblies 10 and two lifting devices 120 may be used to lift and transport the load 118. In this embodiment, each lifting device 120 may lift one end of the load 118. Once each lifting device 120 has lifted its end of the load 118, both lifting devices 120 may begin moving in the same direction to transport the load 118. Additionally, since the fastener member 48 is capable of being rotated 360 degrees about a vertical axis, one lifting device 120 is capable of moving about the other lifting device 120 while both lifting devices 10 are connected to the load 118. Additionally, due to the improved design of the lifting assembly 10, there is decreased wear on the connecting assembly 119 and fastener member 48 as the fastener member 48 is able to rotate 360 degrees about a vertical axis and pivot up to 15 degrees from the vertical axis. Further, the improved design of the lifting assembly 10 allows a load of up to 45 tons to be lifted and transported.

Each apparatus, system, and assembly described herein may include any combination of the described components, features, and/or functions. Each method described herein may include any combination of the described steps in any order, including the absence of certain described steps. Any recitation of a numeric range herein shall be construed to include any subrange therein.

The embodiments shown in the drawings and described above are exemplary of numerous embodiments that may be made within the scope of the appended claims. It is contemplated that numerous other configurations may be used, and the material of each component may be selected from numerous materials other than those specifically disclosed. In short, it is the applicant's intention that the scope of the patent issuing herefrom will be limited only by the scope of the appended claims.

What is claimed is:

1. A lifting assembly for lifting a load comprising:

a frame including a central portion having a pair of side members with opposing end, a support member transversely positioned between the two side members, and two spaced apart and parallel lifting portions each operatively positioned at one of the opposing ends of the pair of side members and being perpendicular thereto, the central portion and lifting portions defining a suspension space below the central portion and between the lifting portions, wherein the support member includes an aperture extending there-through from an upper surface to a lower surface, and wherein each lifting portion is configured to engage a lifting device;

a rotation member disposed above the aperture of the support member, the rotation member including a housing containing a ball member configured to rotate and pivot in all directions relative to the frame.

2. The lifting assembly of claim 1, wherein the housing includes a top member and a bottom member, wherein the top member and the bottom member engage one another to define a rotation cavity, and wherein the ball member is disposed within the rotation cavity.

3. The lifting assembly of claim 2, wherein the rotation cavity is formed by a recessed surface of the top member and a bore through the bottom member, wherein the bore of the bottom member includes a top bore portion with a curved profile, the bore further including a lower bore portion with a restricted diameter relative to the top bore portion.

4. The lifting assembly of claim 3, wherein the ball member includes an outer curved surface having a reciprocal shape to the curved profile of the top bore portion.

5. The lifting assembly of claim 4, wherein the ball member rotates 360 degrees within the rotation cavity about a vertical axis and pivots 15 degrees from the vertical axis.

6. The lifting assembly of claim 5, further comprising a fastener member secured to the ball member and extending through the aperture of the support member, wherein the fastener member rotates 360 degrees about the vertical axis and pivots 15 degrees from the vertical axis with the ball member.

7. The lifting assembly of claim 6, wherein each lifting portion includes a lifting receptacle for receiving a prong of a fork lift.

8. The lifting assembly of claim 1, wherein the lifting assembly is capable of suspending a load having a weight of 45 tons.

9. A method for lifting a load, comprising the steps of:

a) providing a lifting assembly comprising: a frame including a central portion interconnecting two spaced apart lifting portions and a suspension space defined below the central portion and between the lifting portions, wherein the central portion includes an aperture, and wherein each lifting portion is configured to engage a lifting device; a rotation member disposed above the aperture of the central portion, wherein a portion of the rotation member rotates and pivots relative to the frame;

b) attaching a fastener member to a load;

c) attaching the fastener member to the rotation member to suspend the load within or below the suspension space;

d) engaging the lifting portions of the lifting assembly with a lifting device; and e) lifting the load with the lifting device.

10. The method of claim 9, wherein the lifting device is a fork lift.

11. The method of claim 9, further comprising the step of:

f) using the lifting device to rotate or pivot the load relative to the frame within the suspension space.

12. The method of claim 11, wherein the rotation member includes a top member, a bottom member, and a ball member, wherein the ball member is disposed within a rotation cavity defined by the top member engaging the bottom member, wherein the ball member rotates and pivots within the rotation cavity, and wherein in step (c) the fastener member is attached to the ball member, and wherein in step (f) the ball member and the fastener member rotate or pivot as the load rotates or pivots.

13. The method of claim 9, wherein in step (e) the lifting device lifts a first end of the load, and wherein the method further includes the steps of:

d1) providing a second lifting assembly comprising: a second frame including a second central portion interconnecting two spaced apart lifting portions and a second suspension space defined below the second central portion and between the lifting portions, wherein the second central portion includes an aperture, and wherein each lifting portion is configured to engage a second lifting device; a second rotation member disposed above the aperture of the second central portion, wherein a portion of the second rotation member rotates and pivots relative to the second frame;

d2) attaching a second fastener member to a second end of the load;

d3) attaching the second fastener member to the second rotation member to suspend the second end of the load within or below the second suspension space;

d4) engaging the lifting portions of the second lifting assembly with a second lifting device; and e1) lifting the second end of the load with the second lifting device to completely suspend the load.

14. The method of claim 13, wherein the method further includes the step of:

f) transporting the load with the lifting device and the second lifting device, wherein the first end of the load rotates or pivots relative to the frame of the lifting assembly, and wherein the second end of the load rotates or pivots relative to the second frame of the second lifting assembly.

15. The method of claim 14, wherein the portion of the rotation member and the portion of the second rotation member each rotates 360 degrees about a vertical axis and 15 degrees from the vertical axis.

16. The method of claim 15, wherein the load weighs 45 tons.

* * * * *